US009615191B1

(12) United States Patent
Hernandez Garcia et al.

(10) Patent No.: US 9,615,191 B1
(45) Date of Patent: Apr. 4, 2017

(54) AUDIO SIGNAL PROCESSING METHOD FOR OUT-OF-PHASE ATTENUATION OF SHARED ENCLOSURE VOLUME LOUDSPEAKER SYSTEMS AND APPARATUS USING THE SAME

(71) Applicant: Merry Electronics(Shenzhen) Co., Ltd., Guangdong (CN)

(72) Inventors: Diego Jose Hernandez Garcia, Taichung (TW); Yu-Hsuan Lin, Taichung (TW); Wen-Hong Wang, Taichung (TW)

(73) Assignee: Merry Electronics(Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/076,686

(22) Filed: Mar. 22, 2016

(30) Foreign Application Priority Data

Feb. 2, 2016 (TW) ..... 105103375

(51) Int. Cl.
*H04S 3/00* (2006.01)
*H04S 7/00* (2006.01)
*H04R 5/02* (2006.01)

(52) U.S. Cl.
CPC ..... *H04S 7/307* (2013.01); *H04R 5/02* (2013.01); *H04S 3/008* (2013.01)

(58) Field of Classification Search
CPC . H04S 3/00; H04S 1/002; H04S 1/003; H04R 2499/13
USPC ..... 381/303, 300–302, 1, 119, 18, 27, 307, 381/86, 97, 98
See application file for complete search history.

(56) References Cited

U.S. PATENT DOCUMENTS 7,369,666 B2 * 5/2008 Tatsuta ..... H04S 3/00 381/1
2007/0223713 A1 9/2007 Gunness
2008/0159545 A1 * 7/2008 Takumai ..... H04R 1/403 381/17

FOREIGN PATENT DOCUMENTS

| | | |
|---|---|---|
| CN | 103181191 | 6/2013 |
| TW | I249361 | 2/2006 |
| TW | I339991 | 4/2011 |
| TW | I477158 | 3/2015 |

* cited by examiner

*Primary Examiner* — Melur Ramakrishnaiah
(74) *Attorney, Agent, or Firm* — Jianq Chyun IP Office

(57) ABSTRACT

An audio signal processing apparatus configured to process a plurality of audio signals of a shared-volume stereo system is provided. The audio signal processing apparatus includes a plurality of signal processing channels. The signal processing channels are configured to filter the audio signals to obtain high-frequency components and low-frequency components. The signal processing channels perform a signal processing operation on the low-frequency components to generate a low-frequency modulation signal. The signal processing channels sum up the high-frequency components and the low-frequency modulation signal to reproduce a plurality of audio reproduction signals. The signal processing channels drive loudspeakers of the shared-volume stereo system according to the audio reproduction signals. Furthermore, an audio signal processing method is also provided.

14 Claims, 7 Drawing Sheets

AUDIO SIGNAL PROCESSING METHOD FOR OUT-OF-PHASE ATTENUATION OF SHARED ENCLOSURE VOLUME LOUDSPEAKER SYSTEMS AND APPARATUS USING THE SAME

CROSS-REFERENCE TO RELATED APPLICATION

This application claims the priority benefit of Taiwan application serial no. 105103375, filed on Feb. 2, 2016. The entirety of the above-mentioned patent application is hereby incorporated by reference herein and made a part of this specification.

BACKGROUND OF THE INVENTION

1. Field of the Invention

The invention relates to a signal processing apparatus and a method for processing signals, and particularly relates to an audio signal processing apparatus and a method for processing audio signals.

2. Description of Related Art

In a portable stereo system, loudspeakers usually share the same volume with each other to facilitate a low-frequency response. When the loudspeakers play different audio channels and share the same volume, they are easily affected by each other. Such phenomenon has a significant impact on the loudspeaker at the low-frequency. Specifically, clipping distortion may easily occur.

FIGS. 1 and 2 are respectively schematic views illustrating a shared-volume stereo system according to the conventional art. Referring to FIGS. 1 and 2, a shared-volume stereo system 100 includes a left channel loudspeaker 110 and a right channel loudspeaker 120. FIG. 1 is a schematic view illustrating cone excursions d1 of the left channel loudspeaker 110 and the right channel loudspeaker 120 when the left channel loudspeaker 110 and the right channel loudspeaker 120 are driven by low-frequency audio signals S1 and S2. In FIG. 1, the audio signals S1 and S2 are in-phase. Thus, when the left channel loudspeaker 110 and the right channel loudspeaker 120 are driven, the cone excursions thereof are in the same direction, such as toward inside or outside of the volume at the same time. Thus, the stereo system 100 may normally output a sound signal S3.

FIG. 2 is a schematic view illustrating cone excursions d2 of the left channel loudspeaker 110 and the right channel loudspeaker 120 when the left channel loudspeaker 110 and the right channel loudspeaker 120 are driven by the low-frequency audio signals S1 and S2. In FIG. 2, the audio signals S1 and S2 are out-of-phase. Thus, when the left channel loudspeaker 110 and the right channel loudspeaker 120 are driven, the cone excursions are not in the same direction. For example, the cone excursion of the left channel loudspeaker 110 is toward outside of the volume, while the cone excursion of the right channel loudspeaker 110 is toward inside of the volume. Thus, clipping distortion may occur in a sound output by the left channel loudspeaker 110 and the right channel loudspeakers 120. A waveform thereof is as shown by a sound signal S4. The waveform indicates that there is substantially no sound output from the stereo system 100. Namely, there are cone excursions both for the left channel loudspeaker 110 and the right channel loudspeaker 120, making the stereo system 100 unable to output a normal sound signal. Thus, how to avoid clipping distortion of the stereo system 100 and provide a preferable sound quality is certainly an important issue to work on.

SUMMARY OF THE INVENTION

The invention provides an audio signal processing apparatus and a method for processing audio signals for driving a stereo system to provide a preferable sound quality.

An audio signal processing apparatus according to an embodiment of the invention is suitable for processing a plurality of audio signals of a shared-volume stereo system. The audio signal processing apparatus includes a plurality of signal processing channels. The signal processing channels filter out high-frequency components and low-frequency components of the audio signals. The signal processing channels perform a signal processing operation on the low-frequency components of the audio signals to generate a low-frequency modulation signal. The signal processing channels respectively sum up the high-frequency components of the audio signals and the low-frequency modulation signal to generate a plurality of audio reproduction signals. Corresponding loudspeakers in the shared-volume stereo system are driven according to the audio reproduction signals. A shared part of the signal processing channels sums up the low-frequency components of the audio signals. The shared part of the signal processing channels includes a divider. The divider is configured to perform a division operation on the summed low-frequency components of the audio signals, so as to generate the low-frequency modulation signal.

According to an embodiment of the invention, the audio signals include a first audio signal and a second audio signal. The signal processing channels include a first signal processing channel and a second signal processing channel. The first signal processing channel receives the first audio signal and filters the first audio signal to generate a high-frequency component and a low-frequency component of the first audio signal. The second signal processing channel receives the second audio signal and filters the second audio signal to generate a high-frequency component and a low-frequency component of the first audio signal.

According to an embodiment of the invention, the shared part of the first signal processing channel and the second signal processing channel performs the signal processing operation on the low-frequency components of the first audio signal and the second audio signal, so as to generate the low-frequency modulation signal.

According to an embodiment of the invention, the first signal processing channel sums up the high-frequency component of the first audio signal and the low-frequency modulation signal to generate a first audio reproduction signal, so as to drive a left channel loudspeaker in the shared-volume stereo system according to the first audio reproduction signal.

According to an embodiment of the invention, the second signal processing channel sums up the high-frequency component of the second audio signal and the low-frequency modulation signal to generate a second audio reproduction signal, so as to drive a right channel loudspeaker in the shared-volume stereo system according to the second audio reproduction signal.

According to an embodiment of the invention, each of the signal processing channels includes a high pass filter and a low pass filter. The high pass filter filters out the high-frequency component of the received audio signal. The low pass filter filters out the low-frequency component of the received audio signal.

According to an embodiment of the invention, each of the signal processing channels further includes a first adder. The first adder sums up the high-frequency component of the received audio signal and the low-frequency modulation signal to generate the audio reproduction signal.

According to an embodiment of the invention, a shared part of the signal processing channels includes a second adder. The second adder sums up the low-frequency components of the audio signals.

According to an embodiment of the invention, the audio signals are out-of-phase. Amplitudes of the audio signals are substantially greater than amplitudes of the audio reproduction signals.

A method for processing audio signals according to an embodiment of the invention is suitable for processing a plurality of audio signals of a shared-volume stereo system. The method for processing audio signals includes: filtering out high-frequency components and low-frequency components of the audio signals; performing a signal processing operation on the low-frequency components of the audio signals to generate a low-frequency modulation signal; respectively summing up the high-frequency components of the audio signals and the low-frequency modulation signal to generate a plurality of audio reproduction signals; and driving corresponding loudspeakers in the shared-volume stereo system according to the audio reproduction signals. The step of performing the signal processing operation on the low-frequency components of the audio signals to generate the low-frequency modulation signal includes summing up the low-frequency components of the audio signals and performing a division operation on the summed low-frequency components of the audio signals to generate the low-frequency modulation signal.

According to an embodiment of the invention, the audio signals include a first audio signal and a second audio signal. The step of filtering out the high-frequency components and the low-frequency components of the audio signals includes: filtering the first audio signal to generate the high-frequency component and the low-frequency component; and filtering the second audio signal to generate the high-frequency component and the low-frequency component.

According to an embodiment of the invention, the step of respectively summing up the high-frequency components of the audio signals and the low-frequency modulation signal to generate the audio reproduction signals includes: summing up the high-frequency component of the first audio signal and the low-frequency modulation signal to generate a first audio reproduction signal; and summing up the high-frequency component of the second audio signal and the low-frequency modulation signal to generate a second audio reproduction signal.

According to an embodiment of the invention, the step of driving the corresponding loudspeakers in the shared-volume stereo system according to the audio reproduction signals includes: driving a left channel loudspeaker in the shared-volume stereo system according to the first audio reproduction signal; and driving a right channel loudspeaker in the shared-volume stereo system according to the second audio reproduction signal.

According to an embodiment of the invention, the audio signals are out-of-phase. Amplitudes of the audio signals are substantially greater than amplitudes of the audio reproduction signals.

Based on the above, in the embodiments of the invention, the audio signal processing apparatus performs the signal processing operation on the low-frequency components of the audio signals to generate the audio reproduction signals. Then, the audio signal processing apparatus drives the stereo system according to the audio reproduction signals, so as to provide a preferable sound quality.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF THE EMBODIMENTS

Figure 1:
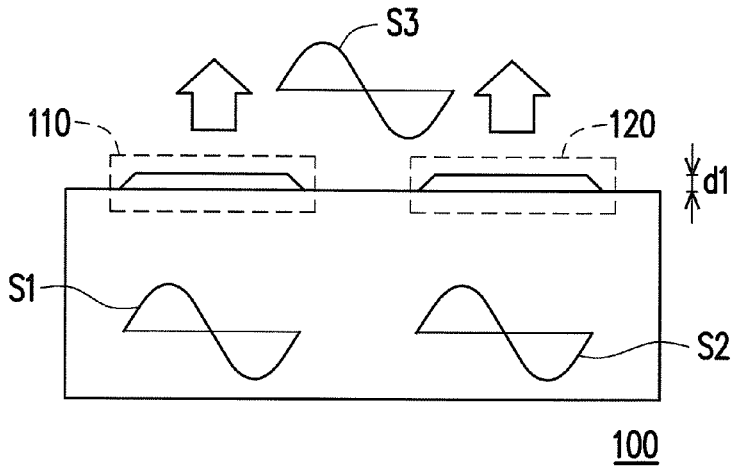
FIGS. 1 and 2 are respectively schematic views illustrating a shared-volume stereo system according to the conventional art.
Figure 2:
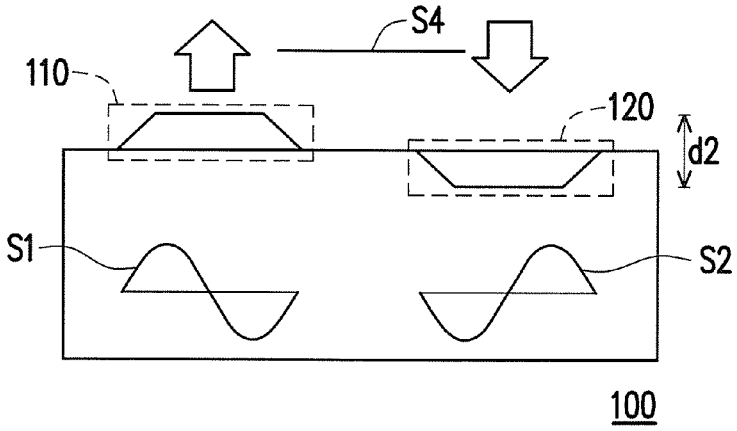

Reference will now be made in detail to the embodiments of the disclosure, examples of which are illustrated in the accompanying drawings. Wherever possible, the same reference numbers are used in the drawings and the description to refer to the same or like parts.

Several embodiments are provided in the following to describe the invention. However, the invention is not limited to the embodiments described hereinafter. Also, the embodiments may also be suitably combined. Throughout the specification of the invention (including claims), the term "couple" may refer to any direct or indirect connection means. For example, if it is described in the specification that a first device is coupled to a second device, it should be interpreted that the first device may be directly connected to the second device, or the first device may be indirectly connected to the second device through other devices or connection means. Furthermore, the term "signal" here refers to at least one current, voltage, charge, temperature, data, electromagnetic wave, or any other one or more signals.

Figure 3:
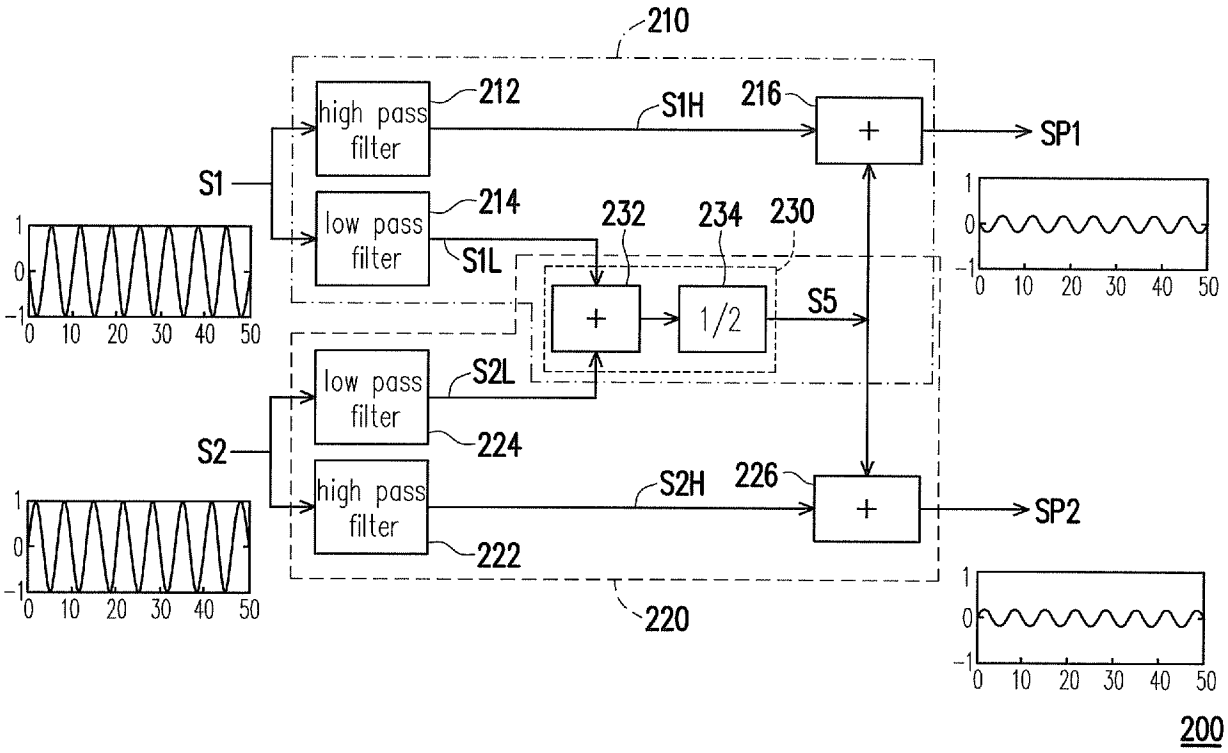
FIGS. 3 to 6 are respectively schematic views illustrating audio signal processing apparatuses for processing audio signals and generating audio reproduction signals according to different embodiments of the invention.

FIG. 3 is a schematic view illustrating an audio signal processing apparatus according to an embodiment of the invention. Referring to FIG. 3, an audio signal processing apparatus 200 of this embodiment is used to process audio signals S1 and S2 of a stereo system 100, for example, so as to prevent clipping distortion of a sound signal S4 at a low frequency. In this embodiment, the audio signal processing apparatus 200 includes a first signal processing channel 210 and a second signal processing channel 220. The first signal processing channel 210 and the second signal processing channel 220 respectively receive and process the audio signals S1 and S2.

Specifically, in this embodiment, the first signal processing channel 210 includes a high pass filter 212, a low pass filter 214, a first adder 216, a second adder 232, and a divider 234. The second signal processing channel 220 includes a high pass filter 222, a low pass filter 224, a first adder 226, the second adder 232, and the divider 234. A shared part of the first signal processing channel 210 and the second signal processing channel 220 includes the second adder 232 and the divider 234. In this embodiment, the audio signal processing apparatus 200 further includes suitable functional components, such as a computation module, a storage module, a communication module, and a power module, etc. The invention does not intend to impose a limitation in this regard.

In this embodiment, the first signal processing channel 210 uses the high pass filter 212 and the low pass filter 214 respectively to filter the audio signal S1, so as to generate a high-frequency component S1H and a low-frequency component S1L. In the first signal processing channel 210, the high pass filter 212 filters out the high-frequency component S1H of the audio signal S1 and outputs the high-frequency component S1H to the first adder 216. The low pass filter 214 filters out the low-frequency component S1L of the audio signal S1 and outputs the low-frequency component S1L to the second adder 232. In addition, the second signal processing channel 220 uses the high pass filter 222 and the low pass filter 224 respectively to filter the audio signal S2, so as to generate a high-frequency component S2H and a low-frequency component S2L. In the second signal processing channel 220, the high lass filter 222 filters out the high-frequency component S2H of the audio signal S2, and outputs the high-frequency component S2H to the first adder 226. The low pass filter 214 filters out the low-frequency component S2L of the audio signal S2 and outputs the low-frequency component S2L to the second adder 232. In this embodiment, signal waveforms of the audio signals S1 and S2 are as shown in FIG. 3, for example. The audio signals S1 and S2 are low-frequency and out-of-phase signals.

Then, in a shared part 230, the second adder 232 sums up the low-frequency components S1L and S2L, and outputs the summed low-frequency components S1L and S2L to the divider 234. The divider 234 performs a division operation on the summed low-frequency components S1L and S2L, so as to generate a low-frequency modulation signal S5. In this embodiment, the divider 234 generates the low-frequency modulation signal S5 by dividing a sum of the low-frequency components S1L and S2L with 2 to generate the low-frequency modulation signal S5, for example, and outputs the low-frequency modulation signal respectively to the first adders 216 and 226. However, the invention does not intend to impose a limitation in this regard. In other embodiments, the sum of the low-frequency components S1L and S2L may also be adjusted by using other parameters based on practical design needs.

Then, in the first signal processing channel 210, the first adder 216 sums up the high-frequency component S1H and the low-frequency modulation signal S5 to generate a first audio reproduction signal SP1. Accordingly, the first signal processing channel 210 drives a left channel loudspeaker 110 by using the first audio reproduction signal SP1. Meanwhile, in the second signal processing channel 220, the first adder 226 sums up the high-frequency component S2H and the low-frequency modulation signal S5 to generate a second audio reproduction signal SP2. Accordingly, the second signal processing channel 220 drives a right channel loudspeaker 120 by using the second audio reproduction signal SP2. In this embodiment, signal waveforms of the audio reproduction signals SP1 and SP2 are as shown in FIG. 3, for example. In addition, amplitudes of the audio signals S1 and S2 are substantially greater than amplitudes of the audio reproduction signals SP1 and SP2.

In this embodiment, even though the signal waveforms of the low-frequency and out-of-phase audio signals S1 and S2 are described as an example, the invention is not limited thereto. In other embodiments, the audio signal processing apparatus 200 may also process low-frequency and in-phase audio signals S1 and S2, high-frequency and out-of-phase audio signals S1 and S2, and high-frequency and in-phase audio signals S1 and S2, and generate corresponding audio reproduction signals. The invention does not intend to impose a limitation in this regard.

Figure 4:
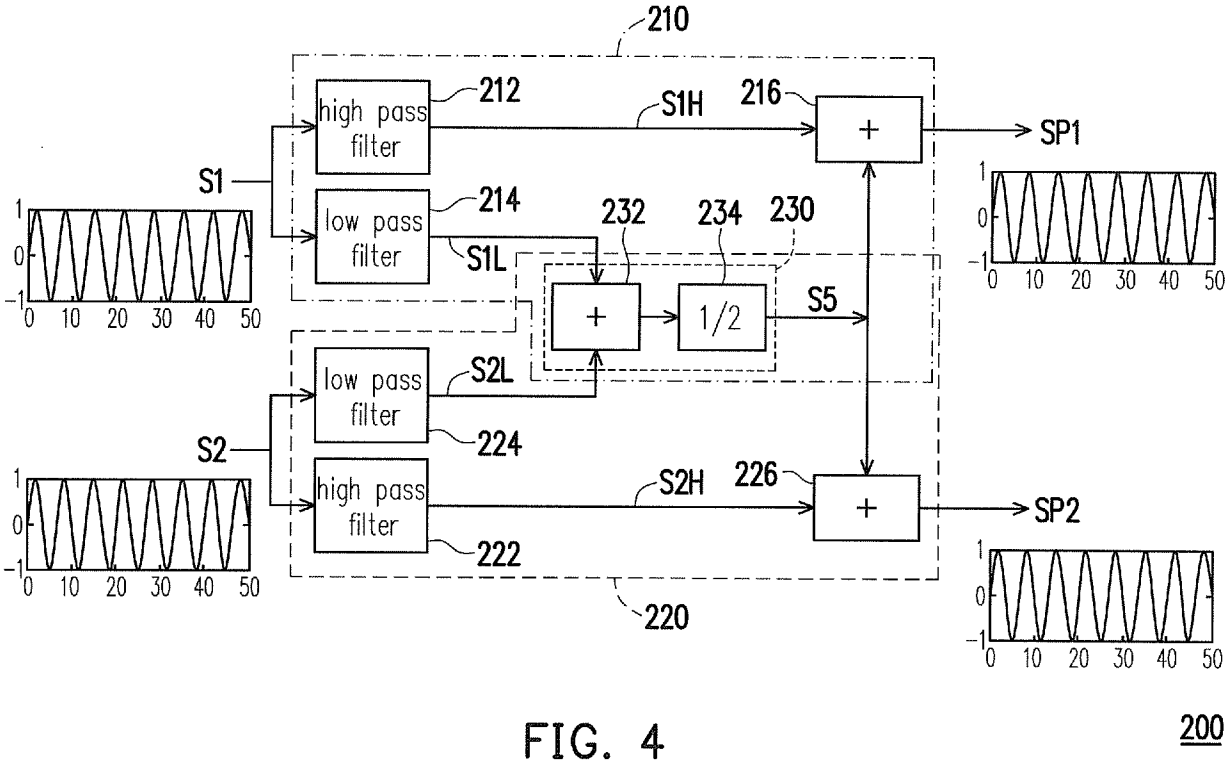
Figure 5:
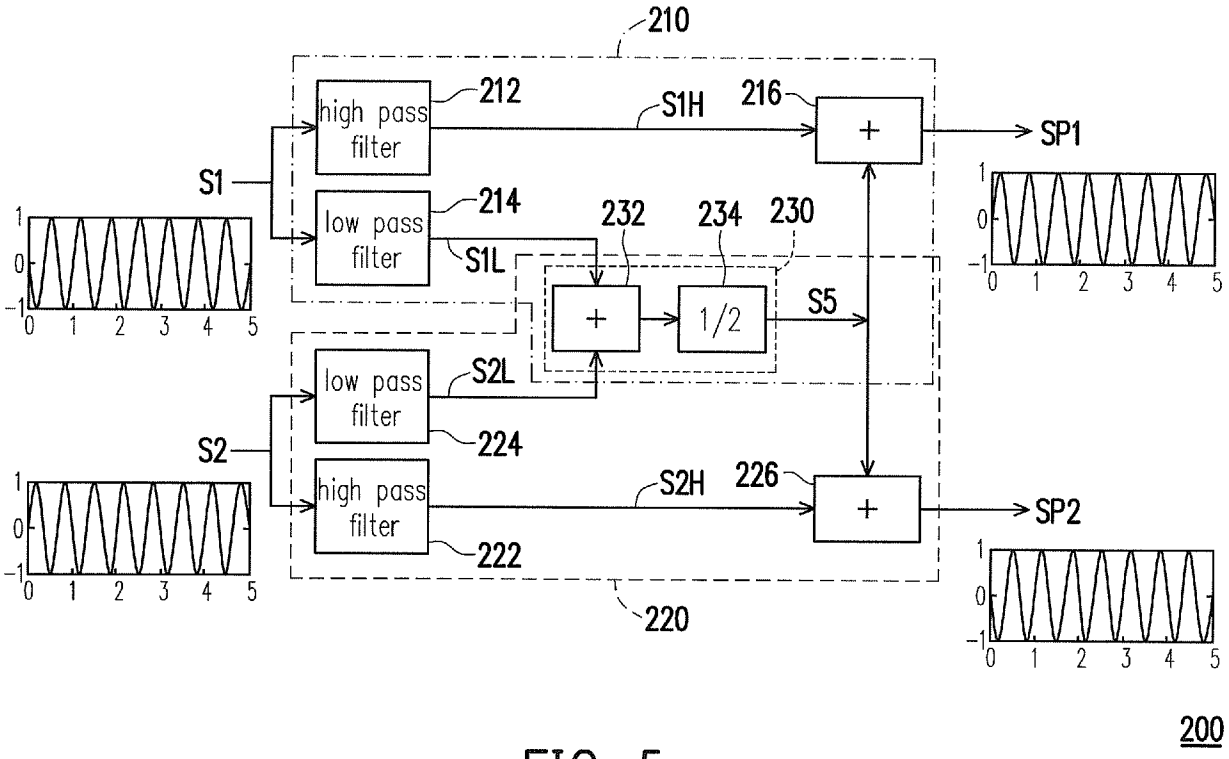
Figure 6:
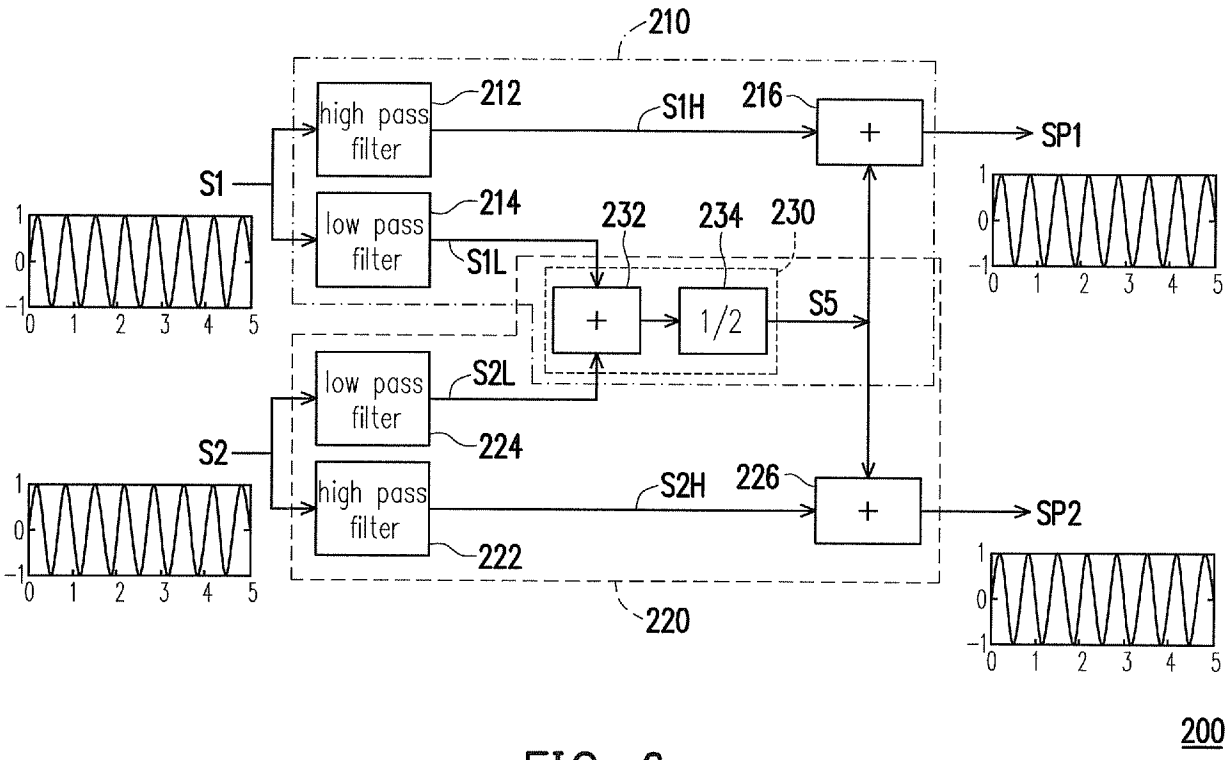

FIGS. 4 to 6 are respectively schematic views illustrating the audio signal processing apparatus for processing audio signals and generating audio reproduction signals according to the embodiment of FIG. 3. In FIG. 4, the audio signal processing apparatus 200 processes the low-frequency and in-phase audio signals S1 and S2. In FIG. 5, the audio signal processing apparatus 200 processes the high-frequency and out-of-phase audio signals S1 and S2. In FIG. 6, the audio signal processing apparatus 200 processes the high-frequency and in-phase audio signals S1 and S2. When the audio signals S1 and S2 are in-phase, disposing the divider 234 allows an audio source to exhibit preferable transparency. For a conventional professional sound system (PSS) where a distance of some centimeters is set between loudspeakers, such audio signal processing is not detectable for the user. When the audio signals S1 and S2 are in-phase, if the divider 234 is not disposed in the audio signal processing apparatus 200, the audio reproduction signals SP1 and SP2 may include multiplied low-frequency components S1L and S2L. Hence, the audio signal processing apparatus 200 needs to perform frequency division on the audio signals S1 and S2 based on the number of loudspeakers. In the exemplary embodiment of the invention, the number of loudspeakers is 2, for example. Thus, the audio signals S1 and S2 are divided by two. However, the invention does not intend to impose a limitation in this regard.

It should be noted herein that sufficient teaching, suggestions, and descriptions for implementation about the methods for processing audio signals in FIGS. 4 and 6 may be obtained from the descriptions of the embodiment shown in FIG. 3. Thus, details in this regard will not be repeated in the following. Based on waveforms of the audio signals and audio reproduction signals shown in FIGS. 3 to 6, it can be known that the audio signal processing apparatus 200 drives the stereo system 100 by using the audio reproduction signals to prevent the clipping distortion of the sound signal at a low frequency. Therefore, the stereo system 100 is able to provide a preferable sound quality.

In this embodiment, respective signal processing modules inside the audio signal processing apparatus 200 may be implemented as software, hardware, or firmware. The invention does not intend to impose a limitation in this regard. For example, the high pass filters 212 and 222 and the low pass filters 214 and 224 may be implemented as software, hardware, or firmware, and the invention does not intend to impose a limitation in this regard. Sufficient teaching, suggestions and descriptions for implementation may be obtained from the common knowledge of the art, and are thus not repeated in the following.

Figure 7:
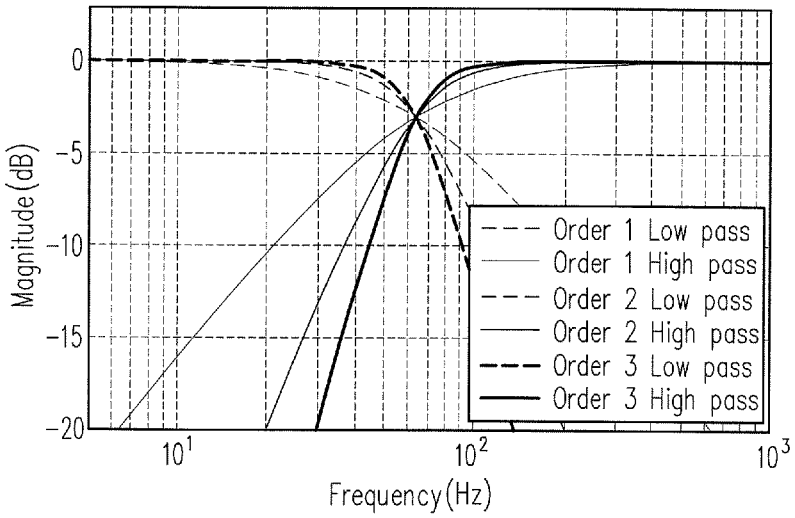
FIG. 7 is a frequency response diagram illustrating high and low pass filters of different orders according to an embodiment of the invention.

FIG. 7 is a frequency response diagram illustrating high and low pass filters of different orders according to an embodiment of the invention. In this embodiment, the high pass filters 212 and 222 are ones selected from first-order, second-order, and third-order high pass filters having frequency response characteristics shown in FIG. 7, so as to filter out the high-frequency components S1H and S2H of the audio signals S1 and S2. In this embodiment, the low pass filters 214 and 224 are ones selected from first-order, second-order, and third-order low pass filters having frequency response characteristics shown in FIG. 7, so as to filter out the low-frequency components S1L and S2L of the audio signals S1 and S2.

Figure 8:
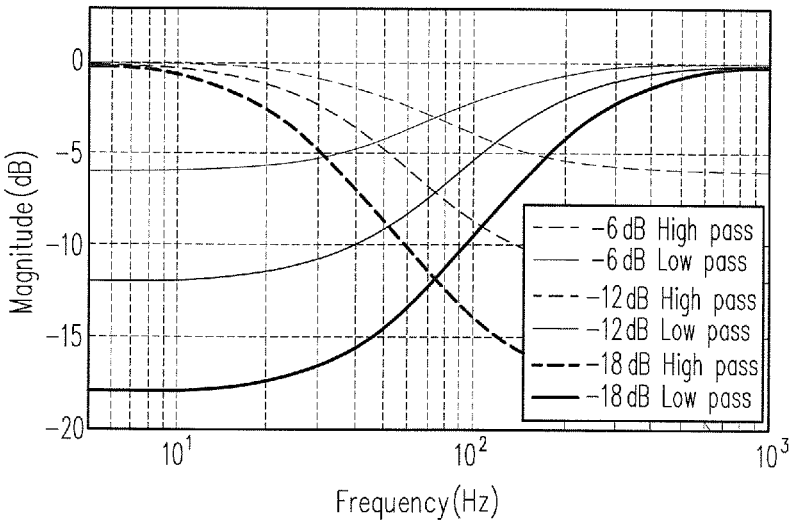
FIG. 8 is a frequency response diagram illustrating shelving filters having different gains according to an embodiment of the invention.

FIG. 8 is a frequency response diagram illustrating shelving filters having different gains according to an embodiment of the invention. In this embodiment, the high pass filters 212 and 222 are ones selected from high pass filters having different gains and having frequency response characteristics shown in FIG. 8, so as to filter out the high-frequency components S1H and S2H of the audio signals S1 and S2. In this embodiment, the low pass filters 214 and 224 are ones selected from low pass filters having different gains and having frequency response characteristics shown in FIG. 8, so as to filter out the low-frequency components S1L and S2L of the audio signals S1 and S2. In addition, the types of filters and the frequency response characteristics of the filters shown in FIGS. 7 and 8 are only provided for an illustrative purpose. The invention is not limited thereto.

Figure 9:
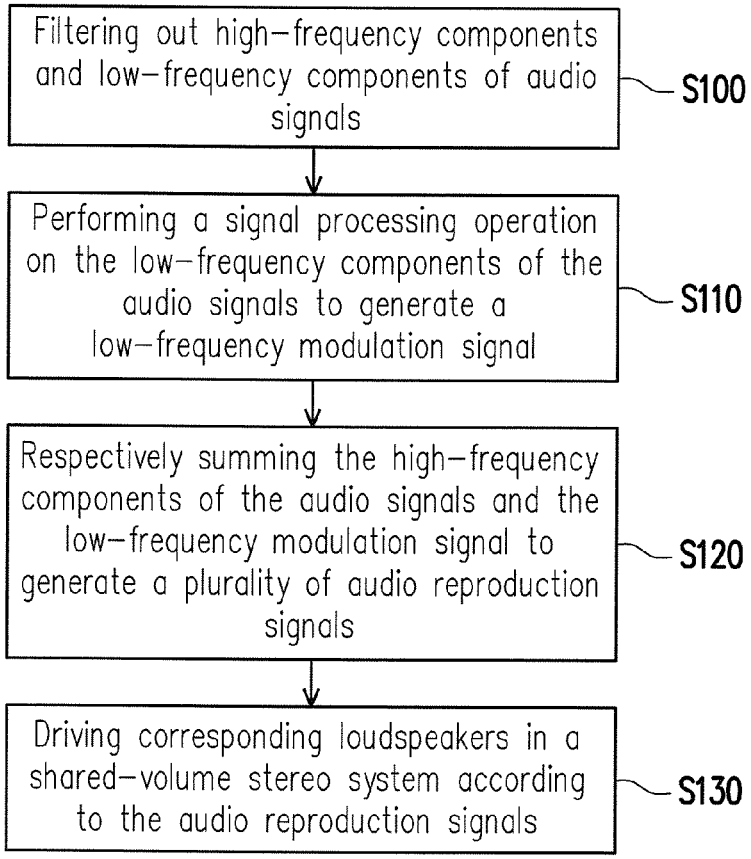
FIG. 9 is a flowchart illustrating a method for processing audio signals according to an embodiment of the invention.

FIG. 9 is a flowchart illustrating a method for processing audio signals according to an embodiment of the invention. Referring FIGS. 3 and 9, the method for processing audio signals of this embodiment is at least suitable for processing a plurality of audio signals of the shared-volume stereo system 100. At Step 100, the audio signal processing apparatus 200 filters out the high-frequency components S1H and S2H and the low-frequency components S1L and S2L of the audio signals S1 and S2. Then, at Step S110, the audio signal processing apparatus 200 performs a signal processing operation on the low-frequency components S1L and S2L of the audio signals S1 and S2, so as to generate the low-frequency modulation signal S5. Subsequently, at Step S120, the audio signal processing apparatus 200 respectively sums up the high-frequency components S1H and S2H of the audio signals S1 and S2 and the low-frequency modulation signal S5, so as to generate the audio reproduction signals SP1 and SP2. Then, at Step S130, the audio signal processing apparatus 200 drives the corresponding loudspeakers 110 and 120 of the shared-volume stereo system 100 according to the audio reproduction signals SP1 and SP2.

In addition, sufficient teaching, suggestions, and descriptions for implementation for the method for processing audio signals according to the embodiments of the invention may be obtained from the embodiments shown in FIGS. 1 to 8, and are thus not repeated in the following.

In view of the foregoing, in the embodiments of the invention, the audio signal processing apparatus performs a signal processing operation on the low-frequency components of the audio signals, and combines the low-frequency component after the signal processing operation with the high-frequency components to generate the audio reproduction signals. Then, the audio signal processing apparatus drives the stereo system according to the audio reproduction signals, so as to prevent the clipping distortion of the sound signal at the low frequency and thus provide a preferable sound quality.

It will be apparent to those skilled in the art that various modifications and variations can be made to the structure of the disclosure without departing from the scope or spirit of the disclosure. In view of the foregoing, it is intended that the disclosure cover modifications and variations of the disclosure provided they fall within the scope of the following claims and their equivalents.

What is claimed is:

1. An audio signal processing apparatus configured to process a plurality of audio signals of a shared-volume stereo system, the audio signal processing apparatus comprising:

a plurality of signal processing channels, filtering out high-frequency components and low-frequency components of the audio signals and performing a signal processing operation on the low-frequency components of the audio signals to generate a low-frequency modulation signal, wherein the signal processing channels sum up the high-frequency components of the audio signals and the low-frequency modulation signal to generate a plurality of audio reproduction signals, so as to drive corresponding loudspeakers in the shared-volume stereo system according to the audio reproduction signals, and a shared part of the signal processing channels sums up the low-frequency components of the audio signals, and the shared part of the signal processing channels comprises a divider configured to perform a division operation on the summed low-frequency components of the audio signals, so as to generate the low-frequency modulation signal.

2. The audio signal processing apparatus as claimed in claim 1, wherein the audio signals comprise a first audio signal and a second audio signal, and the signal processing channels comprise:

a first signal processing channel, receiving the first audio signal and filtering the first audio signal to generate a high-frequency component and a low-frequency component of the first audio signal; and a second signal processing channel, receiving the second audio signal and filtering the second audio signal to generate a high-frequency component and a low-frequency component of the second audio signal.

3. The audio signal processing apparatus as claimed in claim 2, wherein the shared part of the first signal processing channel and the second signal processing channel performs the signal processing operation on the low-frequency components of the first audio signal and the second audio signal, so as to generate the low-frequency modulation signal.

4. The audio signal processing apparatus as claimed in claim 3, wherein the first signal processing channel sums up the high-frequency component of the first audio signal and the low-frequency modulation signal to generate a first audio reproduction signal, so as to drive a left channel loudspeaker in the shared-volume stereo system according to the first audio reproduction signal.

5. The audio signal processing apparatus as claimed in claim 3, wherein the second signal processing channel sums up the high-frequency component of the second audio signal and the low-frequency modulation signal to generate a second audio reproduction signal, so as to drive a right channel loudspeaker in the shared-volume stereo system according to the second audio reproduction signal.

6. The audio signal processing apparatus as claimed in claim 1, wherein each of the signal processing channels comprises a high pass filter and a low pass filter, the high pass filter filters out the high-frequency component of the received audio signal, and the low pass filter filters out the low-frequency component of the received audio signal.

7. The audio signal processing apparatus as claimed in claim 6, wherein each of the signal processing channels further comprises a first adder configured to sum up the high-frequency component of the received audio signal and the low-frequency modulation signal to generate the audio reproduction signal.

8. The audio signal processing apparatus as claimed in claim 6, wherein a shared part of the signal processing channels comprises a second adder configured to sum up the low-frequency components of the audio signals.

9. The audio signal processing apparatus as claimed in claim 1, wherein the audio signals are out-of-phase, and amplitudes of the audio signals are substantially greater than amplitudes of the audio reproduction signals.

10. A method for processing audio signals, suitable for processing a plurality of audio signals of a shared-volume stereo system, the method comprising:

filtering out high-frequency components and low-frequency components of the audio signals;

performing a signal processing operation on the low-frequency components of the audio signals to generate a low-frequency modulation signal;

respectively summing up the high-frequency components of the audio signals and the low-frequency modulation signal to generate a plurality of audio reproduction signals; and driving corresponding loudspeakers in the shared-volume stereo system according to the audio reproduction signals, wherein the step of performing the signal processing operation on the low-frequency components of the audio signals to generate the low-frequency modulation signal comprises:

summing up the low-frequency components of the audio signals; and performing a division operation on the summed low-frequency components of the audio signals to generate the low-frequency modulation signal.

11. The method for processing the audio signals as claimed in claim 10, wherein the audio signals comprise a first audio signal and a second audio signal, and the step of filtering out the high-frequency components and the low-frequency components of the audio signals comprises:

filtering the first audio signal to generate the high-frequency component and the low-frequency component; and filtering the second audio signal to generate the high-frequency component and the low-frequency component.

12. The method for processing the audio signals as claimed in claim 11, wherein the step of respectively summing up the high-frequency components of the audio signals and the low-frequency modulation signal to generate the audio reproduction signals comprises:

summing up the high-frequency component of the first audio signal and the low-frequency modulation signal to generate a first audio reproduction signal; and summing up the high-frequency component of the second audio signal and the low-frequency modulation signal to generate a second audio reproduction signal.

13. The method for processing the audio signals as claimed in claim 12, wherein the step of driving the corresponding loudspeakers in the shared-volume stereo system according to the audio reproduction signals comprises:

driving a left channel loudspeaker in the shared-volume stereo system according to the first audio reproduction signal; and driving a right channel loudspeaker in the shared-volume stereo system according to the second audio reproduction signal.

14. The method for processing the audio signals as claimed in claim 10, wherein the audio signals are out-of-phase, and amplitudes of the audio signals are substantially greater than amplitudes of the audio reproduction signals.

* * * * *